US008144170B2

(12) United States Patent
Huang

(10) Patent No.: US 8,144,170 B2
(45) Date of Patent: Mar. 27, 2012

(54) APPARATUS FOR SCALING IMAGE AND LINE BUFFER THEREOF

(75) Inventor: Chung-Hsun Huang, Sinshih Township (TW)

(73) Assignee: Himax Technologies Limited, Tainan County (TW)

( * ) Notice: Subject to any disclaimer, the term of this patent is extended or adjusted under 35 U.S.C. 154(b) by 1386 days.

(21) Appl. No.: 11/692,244

(22) Filed: Mar. 28, 2007

(65) Prior Publication Data

US 2008/0238943 A1 Oct. 2, 2008

(51) Int. Cl.
*G09G 5/00* (2006.01)

(52) U.S. Cl. ..... 345/660; 345/634; 345/204; 345/206; 345/211; 345/213

(58) Field of Classification Search ..... 345/539, 345/572, 574, 634, 660, 203–206, 211–213, 345/545–565, 504, 604; 358/1.2; 365/221; 382/298, 300, 151, 263, 279; 348/231.6, 348/581, 441, 445, 555, 87; 711/149, 167
See application file for complete search history.

(56) References Cited

U.S. PATENT DOCUMENTS 4,459,677 A * 7/1984 Porter et al. ..... 345/537
4,475,161 A * 10/1984 Stock ..... 345/604
4,564,915 A * 1/1986 Evans et al. ..... 345/550
4,670,711 A * 6/1987 Daniels ..... 324/76.16
5,579,273 A * 11/1996 Childers et al. ..... 365/205
5,621,870 A * 4/1997 Shyu et al. ..... 345/671
5,715,436 A * 2/1998 Kawai et al. ..... 345/505
5,774,110 A * 6/1998 Edelson ..... 345/601
5,825,367 A * 10/1998 Shyu et al. ..... 345/668
5,887,079 A * 3/1999 Endo et al. ..... 382/169
5,986,913 A * 11/1999 Childers et al. ..... 365/51
6,366,692 B1 * 4/2002 Acharya ..... 382/162
6,608,630 B1 * 8/2003 MacInnis et al. ..... 345/634
6,611,260 B1 * 8/2003 Greenberg et al. ..... 345/204
6,628,291 B1 * 9/2003 Edrington et al. ..... 345/545
6,798,420 B1 * 9/2004 Xie ..... 345/554
6,903,733 B1 * 6/2005 Greenberg et al. ..... 345/204
6,943,834 B1 * 9/2005 Hirai ..... 348/231.6
7,365,752 B2 * 4/2008 Xie ..... 345/560
7,490,208 B1 * 2/2009 Yue et al. ..... 711/167
7,533,222 B2 * 5/2009 Leung ..... 711/149
2004/0070687 A1 * 4/2004 Voltz et al. ..... 348/448
2005/0024369 A1 * 2/2005 Xie ..... 345/547
2005/0052441 A1 * 3/2005 Stevens ..... 345/204
2005/0249437 A1 * 11/2005 Wang et al. ..... 382/300
2005/0281111 A1 * 12/2005 Urard et al. ..... 365/221
2006/0146060 A1 * 7/2006 Barlow et al. ..... 345/571
2006/0262099 A1 * 11/2006 Destura et al. ..... 345/173
2007/0016826 A1 * 1/2007 Dubey ..... 714/30
2007/0071103 A1 * 3/2007 Bi et al. ..... 375/240.18
2007/0071360 A1 * 3/2007 Kuroki et al. ..... 382/298
2007/0206206 A1 * 9/2007 Kondo et al. ..... 358/1.2
2008/0005492 A1 * 1/2008 Leung ..... 711/149
2008/0055327 A1 * 3/2008 Rai et al. ..... 345/558

* cited by examiner

*Primary Examiner* — Prabodh M Dharia

(57) ABSTRACT

An apparatus for outputting an image by scaling an original image to a different size is disclosed. The apparatus includes an interpolator and at least one line buffer. The interpolator generates lines of the output image, at least one of which is derived by interpolation of lines of the original image, and the line buffer temporally stores pixels on a same one of the lines of the original image for the interpolation, in which the line buffer has single-port memories and each of the single-port memories is accessed for reading and writing values of the pixels which are non-adjacent to one another. A line buffer is also disclosed herein.

13 Claims, 4 Drawing Sheets

APPARATUS FOR SCALING IMAGE AND LINE BUFFER THEREOF

BACKGROUND

1. Field of Invention

The present invention relates to an apparatus for scaling images and a line buffer thereof. More particularly, the present invention relates to an apparatus for scaling images and a line buffer thereof in a liquid crystal display.

2. Description of Related Art

In order to scale an image based on the requirements of different operation modes, a line buffer is commonly used in the LCD controller to cache the pixel data for interpolations. Furthermore, in order to support the read and write operations of the interpolations simultaneously, a dual port memory is commonly used as the line buffer. However, the dual port memory occupies a large space inside the integrated circuit (IC), and thus it is hard to reduce the product cost and size.

For the foregoing reasons, there is a need for a line buffer that can support the read and write operations simultaneously and have a low cost and small size.

SUMMARY

It is therefore an aspect of the present invention to provide a line buffer that supports the read and write operations simultaneously and reduces the product cost and size at the same time.

In accordance with the embodiment of the present invention, an apparatus is provided to output an image by scaling an original image to a different size. The apparatus includes an interpolator and at least one line buffer. The interpolator generates lines of the output image, at least one of which is derived by interpolation of lines of the original image, and the line buffer temporally stores pixels on a same one of the lines of the original image for the interpolation, in which the line buffer has single-port memories and each of the single-port memories is accessed for reading and writing values of the pixels which are non-adjacent to one another.

In accordance with another embodiment of the present invention, a line buffer is provided to temporally store pixels on a same one of lines of an original image for scaling the original image to a different size by interpolation of the lines of the original image. The line buffer includes single-port memories and each of the single-port memories is accessed for reading and writing values of the stored pixels that are non-adjacent to one another.

It is to be understood that both the foregoing general description and the following detailed description are by examples, and are intended to provide further explanation of the invention as claimed.

BRIEF DESCRIPTION OF THE DRAWINGS

The invention can be more fully understood by reading the following detailed description of the embodiments, with reference made to the accompanying drawings as follows.

DESCRIPTION OF THE PREFERRED EMBODIMENTS

Detailed illustrative embodiments of the present invention are disclosed herein. However, specific details disclosed herein are merely representative for purposes of describing exemplary embodiments of the present invention. This invention may, however, be embodied in many alternate forms and should not be construed as limited to the embodiments set forth herein.

Figure 1:
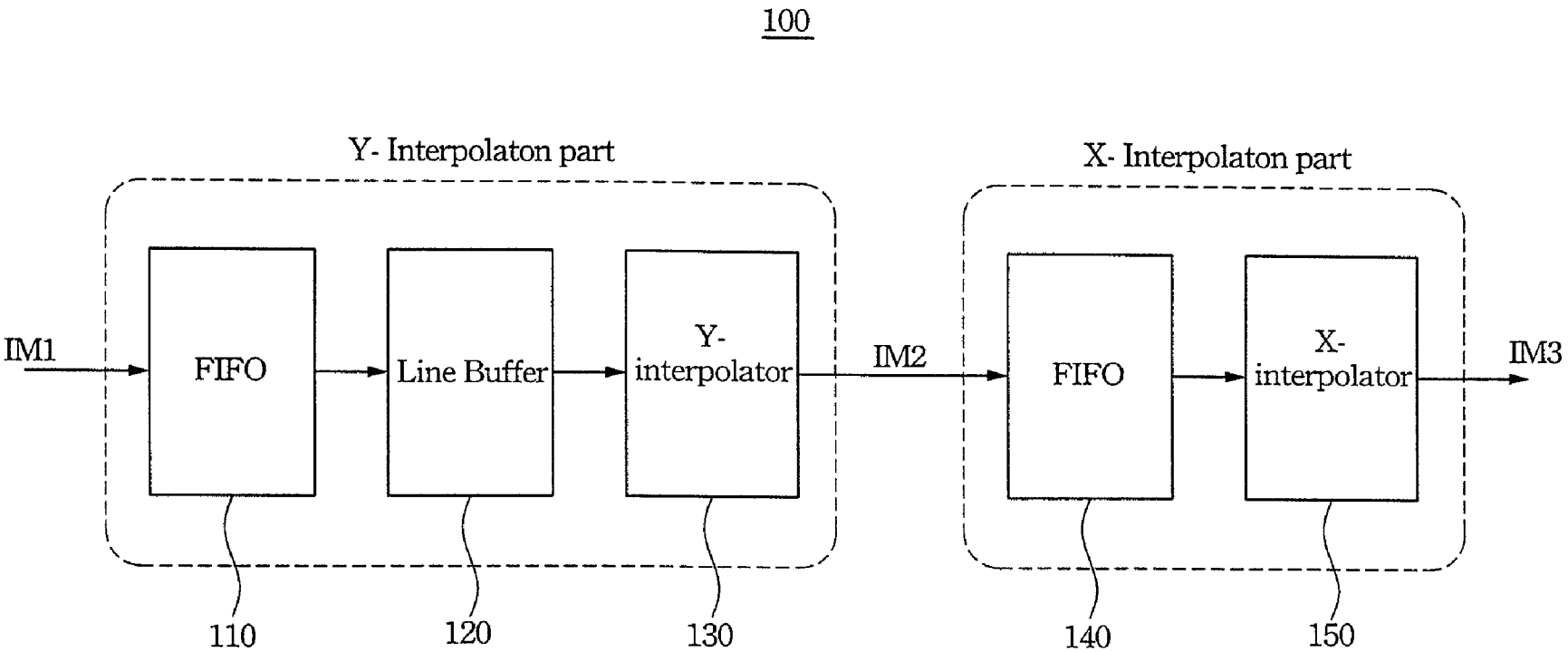
FIG. 1 is a block diagram showing an apparatus for scaling images.

FIG. 1 is a block diagram showing an apparatus for scaling images. The apparatus 100 outputs an image IM3 by scaling an original image IM1 to a different size and is divided into a Y-interpolation part and an X-interpolation part. The Y-interpolation part of the apparatus 100 includes a FIFO (first-in first-out) buffer 110, at least one line buffer 120 and a Y-interpolator 130, and the X-interpolation part of the apparatus 100 includes another FIFO buffer 140 and an X-interpolator 150. The FIFO buffer 110 temporally stores the pixels of the original image IM1 and writes the pixels into the line buffer 120. The line buffer 120 temporally stores the pixels that are on the same one of the lines of the original image IM1 for the interpolation, and the pixels on the same one of the lines of the original image IM1 are addressed according to a sequence thereof, such as pixel 0, 1, 2, 3, . . . . The Y-interpolator 130 outputs an image IM2 and generates the lines of the output image IM2, at least one of which is derived by the interpolation of the lines of the original image IM1 in the Y direction. The FIFO buffer 140 temporally stores the pixels of the image IM2. Then, the X-interpolator 150 outputs the image IM3 and generates the lines of the output image IM3, at least one of which is derived by the interpolation of the lines of the image IM2 in the X direction.

Figure 2:
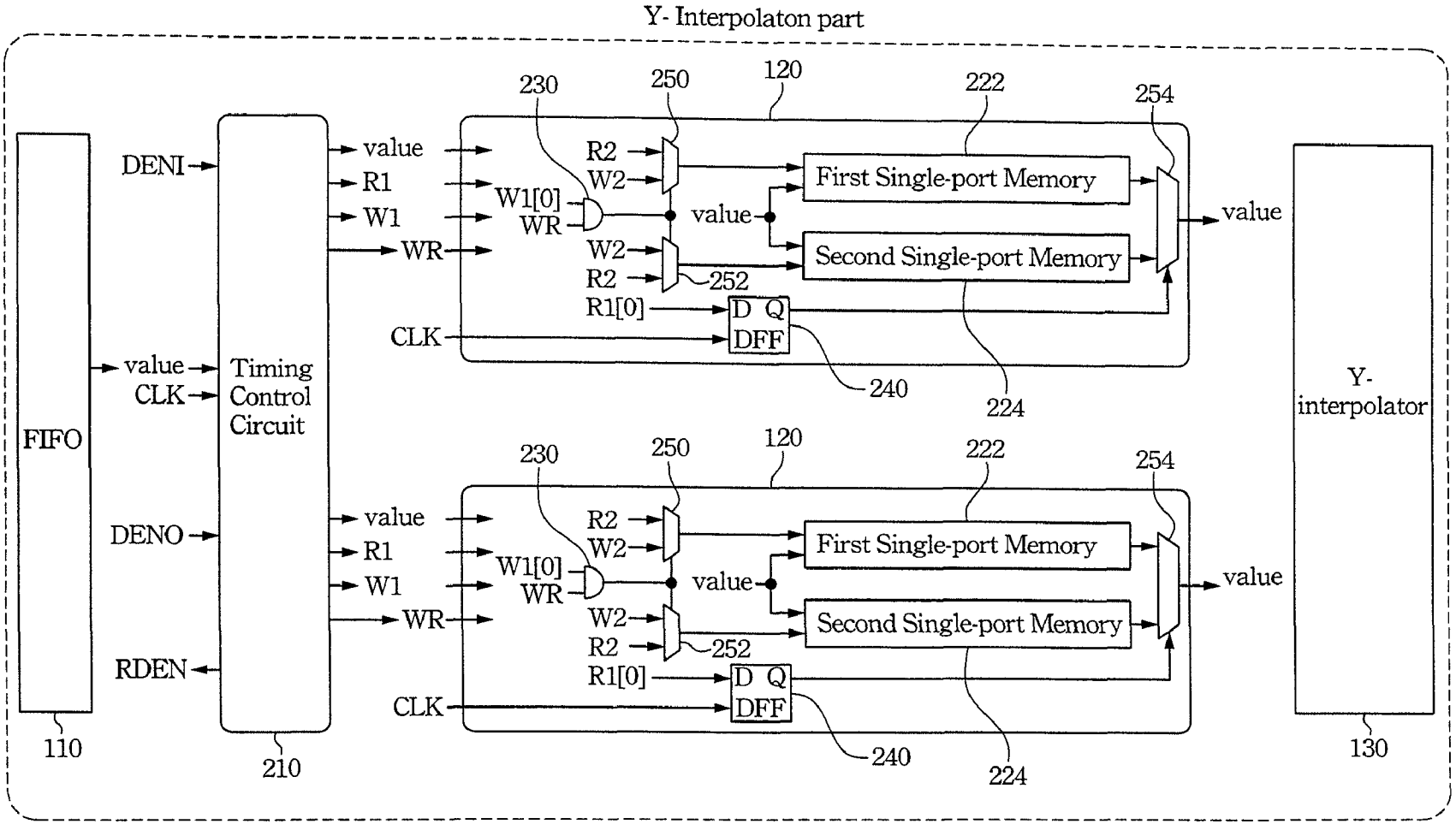
FIG. 2 shows the Y-interpolation part of the apparatus according to one embodiment of the present invention.

FIG. 2 shows the Y-interpolation part of the apparatus according to one embodiment of the present invention. In this embodiment, the Y-interpolation part of the apparatus 100 shown in FIG. 1 is used for bilinear interpolation and includes the FIFO buffer 110, a timing control circuit 210, two same line buffers 120 and the Y-interpolator 130, in which each of the line buffers 120 processes one line of the original image IM1. The timing control circuit 210 receives a clock signal CLK and outputs a read enable signal RDEN for receiving the values of the pixels through the FIFO buffer 110. The timing control circuit 210 also receives an input enable signal DENI to output a first write address W1 for writing the values of the pixels into the line buffers 120, and receives an output enable signal DENO to output a first read address R1 for reading the values of the pixels from the line buffers 120, in which a write enable signal WR is asserted when the first write address W1 is output from the timing control circuit 210. Each of the line buffers 120 has a first single-port memory 222 and a second single-port memory 224, and both the first single-port memory 222 and the second single-port memory 224 are accessed for reading and writing the values of the pixels that are non-adjacent to one another. The first single-port memory 222 is accessed for the odd pixels, and the second single-port memory 224 is accessed for the even pixels, in which the first single-port memory 222 or the second single-port memory 224 can be a static random access memory (SRAM).

Furthermore, each of the first single-port memories 222 and the second single-port memories 224 is accessed using a second write address W2, composed of bits other than the least significant bit (LSB) of the first write address W1, or a second read address R2, composed of bits other than the LSB of the first read address R1.

Each of the line buffers 120 further includes a logic gate 230, a flip-flop 240, a first multiplexer 250, a second multiplexer 252 and a third multiplexer 254. The logic gate 230 asserts a selection signal FS when the write enable signal WR is asserted and the LSB of the first write address W1, i.e. W1[0], is 1, and de-asserts the selection signal FS otherwise. In other words, the logic gate 230 decides whether the value is written into the memories or not, and decides that the value is written into the first single-port memory 222 or the second single-port memory 224. The flip-flop 240 receives the clock signal CLK and temporally stores the LSB of the first read address R1, i.e. R1[0], to decide that the value is read from the first single-port memory 222 or the second single-port memory 224. The first multiplexer 250 transfers the second read address R2 and the second write address W2 to the first single-port memory 222 respectively when the selection signal FS is de-asserted and asserted. The second multiplexer 252 transfers the second read address R2 and second write address W2 to the second single-port memory 224 respectively when the selection signal FS is asserted and de-asserted. The third multiplexer 254 outputs the value read from the first single-port memory 222 and the second single-port memory 224 respectively when the LSB of the first read address R1, i.e. R1[0], output from the flip-flop 240 is 0 and 1, respectively.

When both the first read address R1 and the first write address W1 are output from the timing control circuit 210, the value of the odd pixel is read from the first single-port memory 222 and the value of the even pixel is written into the second single-port memory 224 if the LSBs of the first read address R1 and the first write address W1, i.e. R1[0] and W1[0], are respectively 1 and 0; the value of the even pixel is read from the second single-port memory 224 and the value of the odd pixel is written into the first single-port memory 222 if the LSBs of the first read address R1 and the first write address W1, i.e. R1[0] and W1[0], are respectively 0 and 1.

Figure 3:
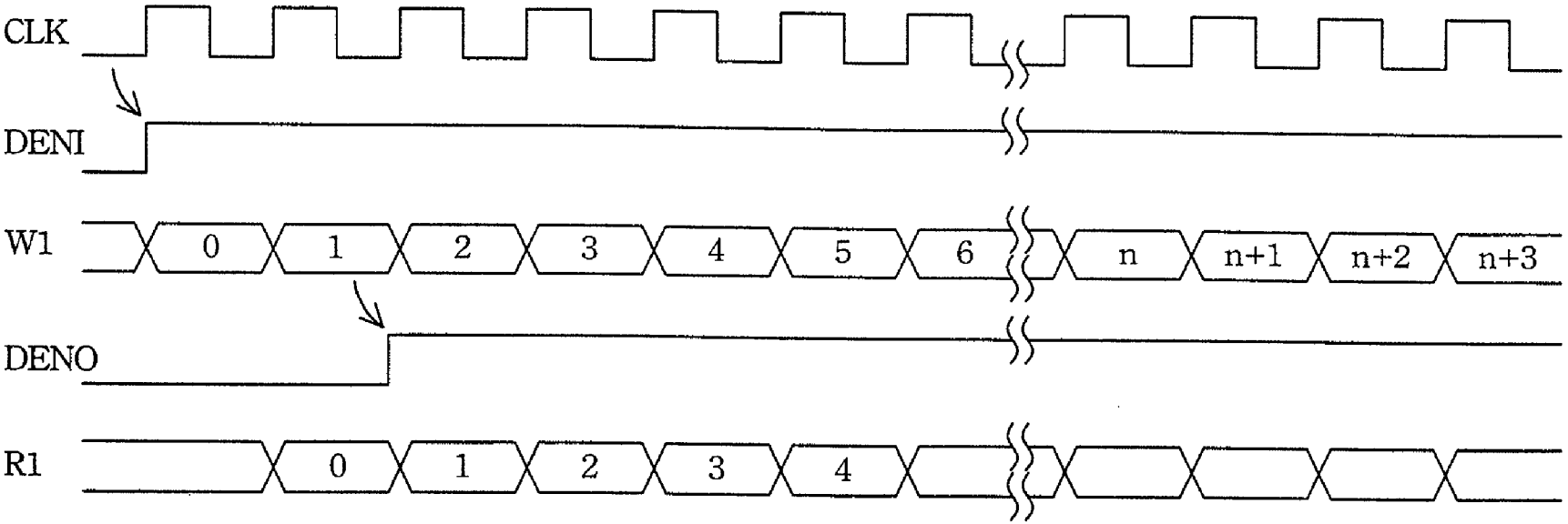
FIG. 3 is a timing diagram showing the operations of write and read of the line buffer in a normal condition.

FIG. 3 is a timing diagram showing the operations of write and read of the line buffer in a normal condition. Referring to FIG. 2 and FIG. 3, when the timing control circuit 210 receives the input enable signal DENI, the first write address W1 is output from the timing control circuit 210 and the addressed pixels 0, 1, 2, 3 . . . are sequentially, according to the clock signal CLK, written into the first single-port memory 222 and the second single-port memory 224, respectively. When the timing control circuit 210 receives the output enable signal DENO, the first read address R1 is output from the timing control circuit 210 and the pixels 0, 1, 2, 3 . . . are sequentially, according to the clock signal CLK, read from the first single-port memory 222 and the second single-port memory 224, respectively.

Figure 4:
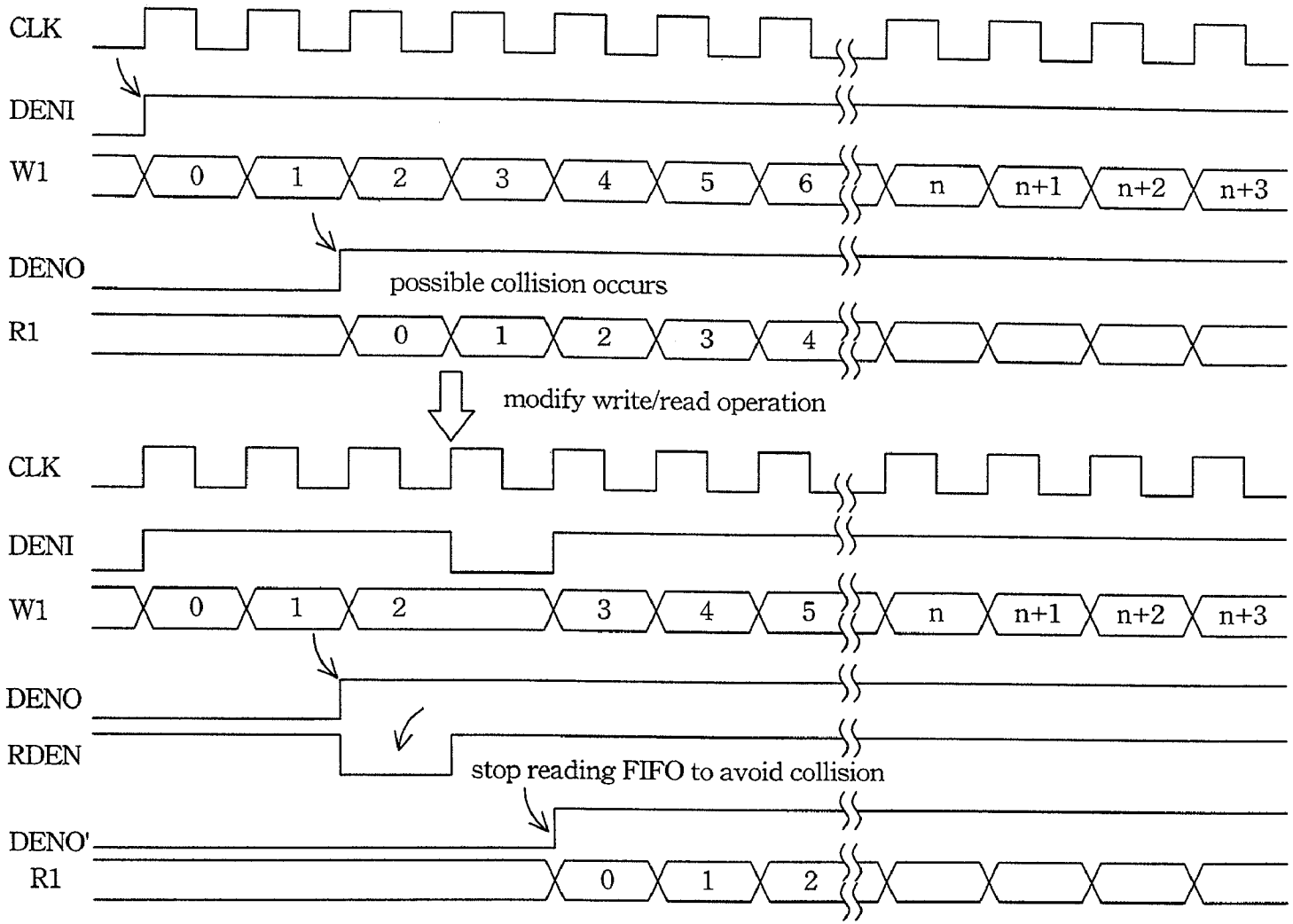
FIG. 4 is a timing diagram showing the operations of write and read of the line buffer in a collision condition.

FIG. 4 is a timing diagram showing the operations of write and read of the line buffer in a collision condition. Referring to FIG. 2 and FIG. 4, when the timing control circuit 210 receives the output enable signal DENO and the input enable signal DENI such that the value of one odd pixel is written into the first single-port memory 222 and the value of another odd pixel is read from the first single-port memory 222 simultaneously, or the value of one even pixel is written into the second single-port memory 224 and the value of another even pixel is read from the second single-port memory 224 simultaneously, the timing control circuit 210 stops outputting a read enable signal RDEN used for asserting the input enable signal DENI and, the writing of the value of the odd or even pixel is temporally stopped; that is, the timing control circuit 210 stops reading the value of the pixel from the FIFO buffer 110. The writing of the value of the odd or even pixel is temporally stopped for one period of the clock signal CLK used for the timing control circuit 210 to receive the values of the pixels.

The FIFO buffer 110 therefore temporally stores the value of the odd or even pixel stopped from being written into the line buffer 120 for one period of the clock signal CLK. On the other hand, the FIFO buffer 110 can also be placed behind the line buffer 120 to temporally store the value of the odd or even pixel stopped from being read from the line buffer 120 for one period of the clock signal CLK. After that, the timing control circuit 210 continues to output the read enable signal RDEN and receives the output enable signal DENO' to carry out the reading operation. Therefore, the operations of write and read of the line buffer 120 are back in the normal condition.

For the foregoing embodiments of the present invention, the apparatus for scaling images and the line buffer thereof are capable of supporting the read and write operations simultaneously and reduce the product cost and size effectively.

As is understood by a person skilled in the art, the foregoing preferred embodiments of the present invention are illustrated of the present invention rather than limiting of the present invention. It is intended to cover various modifications and similar arrangements included within the spirit and scope of the appended claims, the scope of which should be accorded the broadest interpretation so as to encompass all such modifications and similar structures.

What is claimed is:

1. An apparatus for outputting an output image by scaling an original image to a different size, comprising:

an interpolator for generating lines of the output image, at least one line being derived by interpolation of a plurality of lines of the original image;

at least one line buffer for temporally storing pixels on a same one of the plurality of lines of the original image, the at least one line buffer comprising a first single-port memory and a second single-port memory each single-port memory configured to be accessed for reading and writing values of non-adjacent pixels; and a timing control circuit disposed outside the at least one line buffer, the timing control circuit configured to receive an output enable signal to output a first read address for reading a value of a first pixel from the at least one line buffer, and further configured to receive an input enable signal to output a first write address for writing a value of a second pixel into the at least one line buffer;

wherein when both of the first read address and the first write address of the first and second pixels are received, the timing control circuit is configured to read the value of the first pixel from the first single-port memory and to write the value of the second pixel into the second single-port memory if least significant bits of the first read and write addresses are respectively 1 and 0, and wherein the timing control circuit is configured to read the value of the first pixel from the second single-port memory and to write the value of the second pixel into the first single-port memory if least significant bits of the first read and write addresses are respectively 0 and 1; and wherein the timing control circuit is configured to stop outputting a read enable signal used for asserting the input enable signal, and to temporarily stop the writing of the value of the second pixel, when the timing control circuit receives the output and input enable signals.

2. The apparatus as claimed in claim 1, wherein the pixels are configured to be addressed according to a sequence thereof.

3. The apparatus as claimed in claim 1, wherein the first single-port memory and the second single-port memory are configured to be respectively accessed for odd and even pixels.

4. The apparatus as claimed in claim 3, wherein each of the first and second single-port memories is configured to be accessed using a second write address composed of bits of the first write address other than the least significant bit or a second read address composed of bits of the first read address other than the least significant bit.

5. The apparatus as claimed in claim 1, wherein the timing control circuit is configured to assert a write enable signal when the first write address is output from the timing control circuit.

6. The apparatus as claimed in claim 5, wherein the at least one line buffer further comprises:

a logic gate for asserting a first selection signal when the write enable signal is asserted and the least significant bit of the first write address is 1, and de-asserting the first selection signal otherwise;

a flip-flop for temporally storing the least significant bit of the first read address;

a first multiplexer for transferring the second read address and second write address to the first single-port memory when the first selection signal is de-asserted and asserted, respectively;

a second multiplexer for transferring the second read address and second write address to the second single-port memory when the first selection signal is asserted and de-asserted, respectively; and a third multiplexer for outputting the value read from the first and second single-port memories when the least significant bit of the first read address output from the flip-flop is 0 and 1, respectively.

7. The apparatus as claimed in claim 1, further comprising a FIFO buffer for temporally storing the value of the second pixel stopped from being written into the at least one line buffer.

8. The apparatus as claimed in claim 1, wherein the timing control circuit is configured to stop the writing of the value of the second pixel for one period of a clock signal for the timing control circuit to receive the values of the pixels.

9. A line buffer for temporally storing pixels on a same one of lines of an original image for scaling the original image to a different size by interpolation of the lines of the original image, the line buffer comprising:

a first single-port memory and a second single-port memory, each single-port memory is configured to be accessed for reading and writing values of non-adjacent pixels on a same line of an original image; and a timing control circuit disposed outside the line buffer;

wherein when both of a first read and write address, respectively of a first and second pixel, are received, the timing control circuit is configured to read the value of the first pixel from the first single-port memory and to write the value of the second pixel into the second single-port memory if least significant bits of the first read and write addresses are respectively 1 and 0, and wherein the timing control circuit is configured to read the value of the first pixel from the second single-port memory and to write the value of the second pixel into the first single-port memory if least significant bits of the first read and write addresses are respectively 0 and 1;

wherein the timing control circuit is configured to receive an output enable signal to output the first read address for reading the value of the first pixel from the line buffer and to receive an input enable signal to output the first write address for writing the value of the second pixel into the line buffer, and wherein the timing control circuit is configured to stop outputting a read enable signal used for asserting the input enable signal, and temporarily stop the writing of the value of the second pixel, when the timing control circuit receives the output and input enable signals.

10. The line buffer as claimed in claim 9, wherein the first single-port memory and the second single-port memory are configured to be respectively accessed for odd and even pixels.

11. The line buffer as claimed in claim 9, wherein each of the first and second single-port memories is configured to be accessed using a second write address composed of bits of the first write address other than the least significant bit or a second read address composed of bits of the first read address other than the least significant bit.

12. The line buffer as claimed in claim 11, further comprising:

a logic gate for asserting a first selection signal when a write enable signal is asserted and the least significant bit of the first write address is 1, and de-asserting the first selection signal otherwise;

a flip-flop for temporally storing the least significant bit of the first read address;

a first multiplexer for transferring the second read address and second write address to the first single-port memory when the first selection signal is de-asserted and asserted, respectively;

a second multiplexer for transferring the second read address and second write address to the second single-port memory when the first selection signal is asserted and de-asserted, respectively; and a third multiplexer for outputting the value read from the first and second single-port memories when the least significant bit of the first read address output from the flip-flop is 0 and 1, respectively.

13. The line buffer as claimed in claim 9, wherein the timing control circuit is configured to temporarily stop the writing of the value of the second pixel for one period of a clock signal for the timing control circuit to receive the values of the pixels.

* * * * *